US006873809B2

(12) United States Patent
Amemiya et al.

(10) Patent No.: US 6,873,809 B2
(45) Date of Patent: Mar. 29, 2005

(54) IMAGE FORMING APPARATUS AND CLEANING DEVICE THEREFOR

(75) Inventors: Ken Amemiya, Tokyo (JP); Yukiko Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/053,542

(22) Filed: Jan. 24, 2002

(65) Prior Publication Data

US 2002/0106212 A1 Aug. 8, 2002

(30) Foreign Application Priority Data

Jan. 25, 2001 (JP) ..... 2001-017150

(51) Int. Cl.[7] ..... G03G 15/02; G03G 21/00
(52) U.S. Cl. ..... 399/100; 399/174; 399/175
(58) Field of Search ..... 399/100, 168, 399/175, 176, 353; 361/221, 225

(56) References Cited

U.S. PATENT DOCUMENTS 4,741,942 A * 5/1988 Swift ..... 428/82
5,689,791 A * 11/1997 Swift ..... 399/353
6,006,050 A 12/1999 Watanabe
6,014,532 A 1/2000 Takeichi et al.
6,055,388 A 4/2000 Watanabe et al.
6,055,394 A 4/2000 Suda et al.
6,101,351 A 8/2000 Suda et al.
6,118,964 A 9/2000 Kojima et al.
6,173,142 B1 * 1/2001 Kawakami ..... 399/175
6,208,826 B1 3/2001 Yoshinaga et al.
6,219,520 B1 4/2001 Ehara
6,256,465 B1 7/2001 Yoshinaga et al.
6,334,039 B1 12/2001 Yoshinaga et al.
6,336,013 B1 1/2002 Suda et al.
6,366,754 B1 4/2002 Sato et al.
6,381,432 B1 * 4/2002 Hattori ..... 399/176

FOREIGN PATENT DOCUMENTS

JP 8-22173 1/1996
JP 10-20696 1/1998
JP 10-282854 10/1998
JP 11-219048 8/1999

OTHER PUBLICATIONS

Patent Abstracts of Japan, JP 08–095350, Apr. 12, 1996.
Patent Abstracts of Japan, JP 08–062949, Mar. 8, 1996.
Patent Abstracts of Japan, JP 09–114201, May 2, 1997.
Patent Abstracts of Japan, JP 07–140763, Jun. 2, 1995.
Patent Abstracts of Japan, JP 04–060660, Feb. 26, 1992.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A cleaning device including a brush roller that contacts the surface of a charge roller for cleaning it and an image forming apparatus including the cleaning device are disclosed. The brush roller has a brush contacting the charge roller due to the weight of the brush roller. The brush roller rotates by following the rotation of the charge roller. The cleaning device has a simple configuration while the brush roller has high durability.

36 Claims, 2 Drawing Sheets

IMAGE FORMING APPARATUS AND CLEANING DEVICE THEREFOR

BACKGROUND OF THE INVENTION

1. Field of the Invention

The present invention relates to a copier, printer, facsimile apparatus or similar image forming apparatus and more particularly to a cleaning device for an image forming apparatus.

2. Description of the Background Art

A cleaning device for cleaning a desired member has customarily been used in machines and apparatus in various fields. An image forming apparatus, for example, includes a cleaning device for cleaning the surface of an image carrier, a cleaning device for cleaning the surface of a charge roller that charges the image carrier, and a cleaning device for cleaning the surface of an image transfer belt.

Japanese Patent Laid-Open Publication No. 7-140763, for example, discloses a cleaning device using a brush roller that contacts the surface of a member to be cleaned. The brush roller is rotated by a drive source. A brush on the brush roller and the surface of the member to be cleaned each are moved at a particular linear velocity, so that the brush scrapes off impurities deposited on the member.

However, the conventional brush roller type of cleaning device needs the drive source for driving the brush roller. Moreover, this type of cleaning device needs means for limiting the amount of bite of the brush into the desired member in order to control the permanent deformation of the brush. This increases the cost of the cleaning device and makes the cleaning device sophisticated. It is to be noted that the amount of bite of the brush refers to the maximum amount of deformation of the brush roller to occur in the radiation direction when the brush is pressed against the surface of the desired member. It has been customary to control the yield of the brush by confining the amount of bite in an adequate range.

Technologies relating to the present invention are also disclosed in, e.g., Japanese Patent Laid-Open Publication Nos. 8-22173, 10-206696, 10-282854 and 11-219048.

SUMMARY OF THE INVENTION

It is an object of the present invention to provide a cleaning device free from the problems discussed above.

It is another object of the present invention to provide a unit including the cleaning device.

It is still another object of the present invention to provide an image forming apparatus including the cleaning device.

It is a further object of the present invention to provide a brush roller capable of reducing the yield of its brush and usable over a long period of time.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
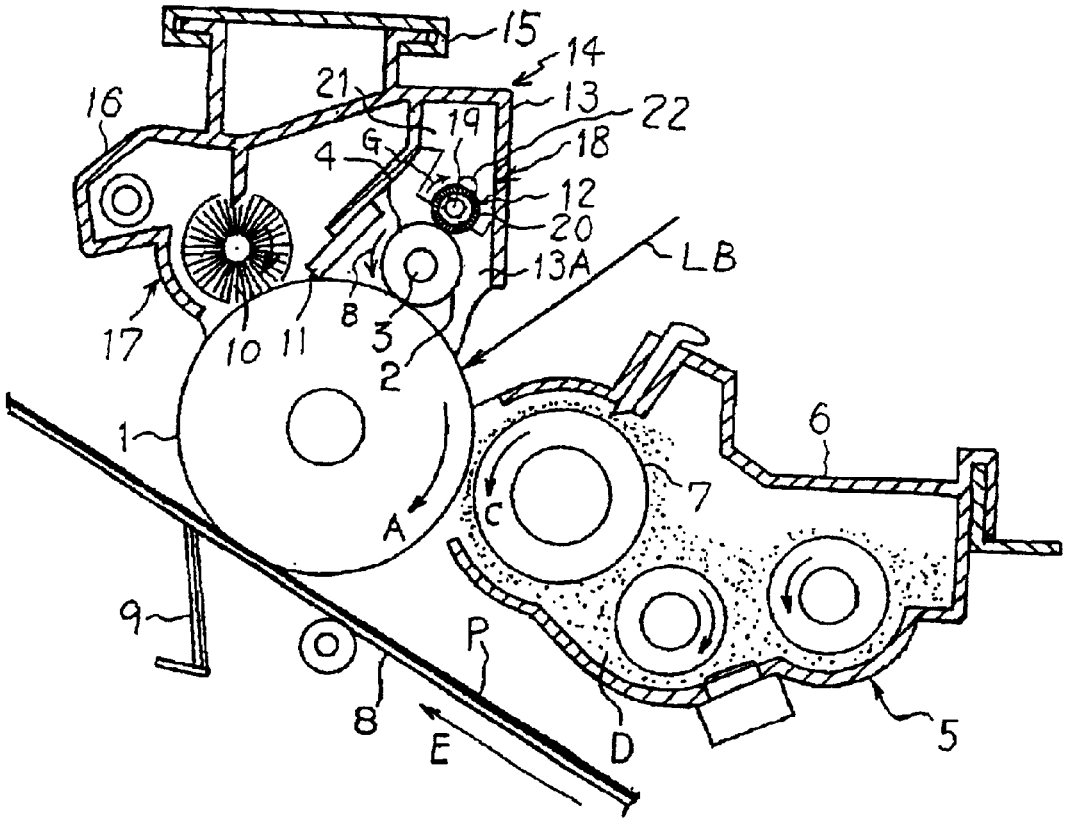
FIG. 1 is a section showing an image forming apparatus embodying the present invention.

Referring to FIG. 1 of the drawings, an image forming apparatus embodying the present invention is shown and includes a charge roller 2 to be cleaned. The image forming apparatus has one or more of an electronic copier function, a printer function, and a facsimile apparatus function. As shown, the image forming apparatus includes an image carrier implemented as a photocoductive drum 1. On the start of an image forming cycle, the drum 1 is caused to rotate in a direction indicated by an arrow A in FIG. 1. The charge roller 2 is located to face the surface of the drum 1. A drive source, not shown, or the drum 1 in rotation causes the charge roller 2 to rotate in a direction indicated by an arrow B. The charge roller 2 is made up of a metallic core 3 and an elastic body 4 affixed to the core 3. While the charge roller 2 is in rotation, a voltage of preselected polarity is applied to the charge roller 2 to thereby charge the surface of the drum 1 to the preselected polarity.

A laser writing unit, not shown, scans the charged surface of the drum 1 with a laser beam LB in accordance with image data, thereby forming a latent image on the drum 1. A developing device 5 develops the latent image with toner to thereby produce a corresponding toner image. More specifically, in the illustrative embodiment, the developing device 5 includes a casing 6 storing a powdery developer D and a sleeve 7 for conveying the developer D deposited thereon. While the sleeve 7 is rotated in a direction indicated by an arrow C in FIG. 1, toner contained in the developer is electrostatically transferred from the sleeve 7 to the latent image, developing the latent image.

An image transfer belt (simply belt hereinafter) 8 faces the drum 1 and moves in a direction indicated by an arrow E in FIG. 1. The belt 8 conveys a sheet or recording medium P fed from a sheet feed section not shown. When the sheet P passes through an image transfer position between the drum 1 and the belt 8, a voltage for image transfer is applied to an image transferring device 9, which faces the drum 1 with the intermediary of the belt 8. The image transferring device 9 electrostatically transfers the toner image from the drum 1 to the sheet P. If desired, the toner image may be transferred from the drum 1 to the sheet P by way of an intermediate image transfer body.

A cleaning brush 10 and a cleaning blade 11 remove the toner left on the drum 1 after the image transfer. On the other hand, a fixing device, not shown, fixes the toner image with heat and pressure.

In the illustrative embodiment, the image carrier, charge roller 2, cleaning brush 10 and a brush roller 12, which will be described layer, are rotatably mounted on a unit case 13. Further, the base end of the cleaning blade 11 is affixed to the unit case 13, completing a single unit 14. The unit 14 is movable into and out of the apparatus body along guide rails 15, as needed. The cleaning brush 10, cleaning blade 11 and a cleaning case 16, which is part of the unit case 13, constitute a cleaning device 17 for cleaning the surface of the drum 1.

As shown in FIG. 1, the charge roller 2 for charging the drum 1 is held in contact with the surface of the drum 1. Alternatively, the charge roller 2 may be slightly spaced from the surface of the rum 1, if desired.

During image forming operation, toner may undesirably passed the cleaning blade 11 and impurities may fly about the inside of the apparatus body and as a result toner may deposit on the surface of the charge roller 2. Such toner and impurities would make the charging of the drum 1 irregular or defective and would thereby lower the image quality of the resulting toner image.

Figure 2:
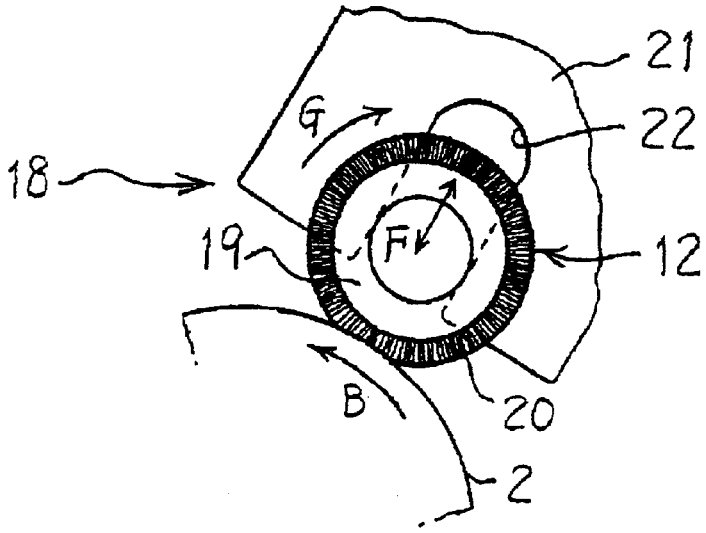
FIG. 2 is an enlarged view of a brush roller included in the illustrative embodiment.
Figure 3:
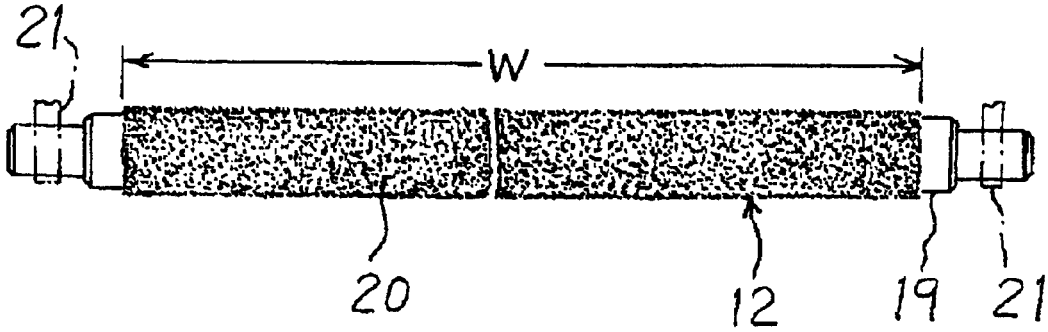
FIG. 3 is a front view showing the brush roller.
Figure 4:
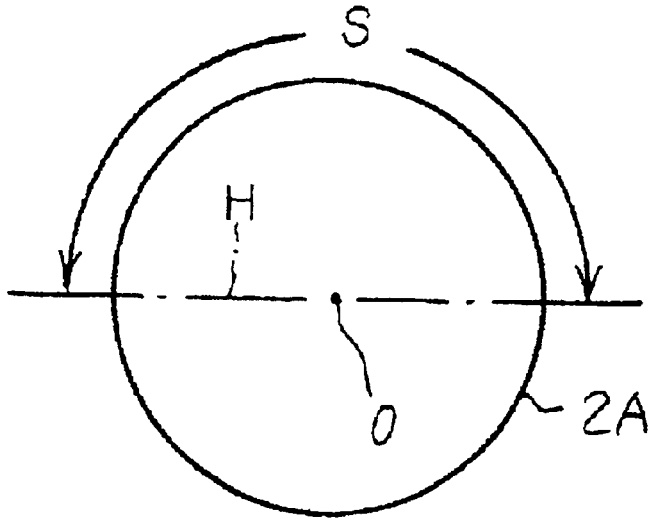
FIG. 4 is a view showing a positional relation between the brush roller and a member to be cleaned thereby.

The illustrative embodiment solves the above problem with a cleaning device 18 assigned to the charge roller 2 and including the brush roller 12. The brush roller 12 extends in parallel to the charge roller 2. As best shown in FIGS. 2 and 3, the brush roller 12 is made up of a rigid core 19 formed of metal or resin and a brush 20 having a number of filaments, which are affixed to the core 19 at base portions thereof. The brush 20 extends over the entire circumference of the core 19 over an axial range W shown in FIG. 3. The brush 20 is held in contact with the charge roller 2, which is a member to be cleaned.

The brush roller 12 is configured such that the brush 20 contacts the surface of the charge roller 2 due to the weight of the brush roller 12. The charge roller 2 in rotation causes the brush roller 12 to rotate in a direction indicated by an arrow G in FIGS. 1 and 2.

More specifically, as shown in FIGS. 1 and 2, the unit case includes a rear side wall 13A and a front side wall, not shown, to each of which a bearing member 21 is affixed. A guide slot 22 is formed in each bearing member 21. Axially opposite ends of the core 19 of the brush roller 12 are respectively rotatably received in the guide slots 22 of the two bearing members 21. In this position, the core 19 is slidable along the guide slots 22 in a direction indicated by an arrow F in FIG. 2, i.e., toward and away from the charge roller 2. The guide slots 22 each have a width slightly greater than the diameter of the core 19, so that the opposite ends of the core 19 are stably received in the guide slots 22 without shaking.

The brush roller 12 is positioned above the charge roller 2. This, coupled with the fact that the core 19 is slidably received in the guide slots 22, allows the brush roller 12 to rest on the surface of the charge roller 2 due to the weight of the brush roller 12. Further, because the core 19 is rotatably received in the guide slots 22, the charge roller 2 rotating in the direction B causes the brush roller 12 to rotate in the direction G. That is, the brush roller 12 follows the rotation of the charge roller 2. In this condition, the brush 20 contacting the surface of the charge roller 2 removes the toner from the above surface.

As stated above, the brush roller 12 is not driven by a drive source, but is driven by the charge roller 2. This obviates the need for an exclusive drive source and thereby simplifies the configuration of the cleaning device 18 while reducing the cost. In addition, the brush 20 does not contact the surface of the charge roller 2 with an excessive force, protecting the surface from wear.

Assume a sum of the radius of the brush roller 12 and that of the charge roller 2 in a condition in which the rollers 12 and 2 do not contact each other, and a distance between the axis of the roller 12 and that of the roller 2 in a condition in which the rollers 12 and 2 contact each other. Then, the amount of bite of the brush 20 is produced by subtracting the above distance from the above sum. If the amount of bite is excessively great, then the filaments of the brush 20 deteriorate soon and permanently deform, i.e., yield. If the amount of bite is excessively small, then the brush 20 fails to efficiently clean the surface of the charge roller 20. It has been customary to adjust the relative position between the brush roller 12 and the charge roller 2 in such a manner as to maintain the distance between them constant, thereby limiting the amount of bite. This, however, needs extra limiting means that would increase the cost of the cleaning device while complicating the configuration.

By contrast, in the illustrative embodiment, the brush roller 12 contacts the surface of the charge roller 2 due to its own weight. It follows that a desired amount of bite of the brush 20 is achievable only if the weight of the brush roller 12 is adjusted, obviating the need for the conventional limiting means. The cleaning device 18 is therefore simple in configuration and low cost.

While the length of the filaments constituting the brush 20 is open to choice, it should preferably be 2 mm or less, more preferably 0.4 mm to 0.6 mm. It should be noted that the length of the filaments excludes the portions affixed to the core 19. The filaments with such a small length successfully reduce a bending moment to act on the base portions of the filaments although the filaments elastically bend in contact with the charge roller 2. The brush 20 is therefore free from yield or permanent deformation over a long period of time and achieves a long life. If the length of the filaments is greater than 2 mm, then the distance between nearby filaments at the tip increases with the result that the load to act on the individual filaments contacting the charge roller 21 increases, aggravating the yield of the brush 20.

It is a common practice to remove toner collected by the end of the brush 20 with a flicker. In the illustrative embodiment, as shown in FIG. 1, it is possible to remove the toner from the end of the brush 20 without resorting to a flicker because the filaments of the brush 20 are short, as stated above. Why a flicker is needless is not clearly accounted for. Presumably, when the filaments of the brush 20 as short as 2 mm or less and elastically deformed in contact with the charge roller 2 leave the charge roller in accordance with the rotation of the brush roller 12, the filaments immediately restore their original position due to elasticity. The resulting shock causes the toner deposited on the tips of the filaments to jump off the filaments.

While the diameter and density of the filaments of the brush 20 are also open to choice, the diameter should preferably be 2 denier or below while the density should preferably be 20,000 filaments/$cm^2$ or above, more preferably 30,000 filaments/$cm^2$. With this configuration, a great number of filaments contact the charge roller 2 with the result that the load to act on the individual filaments decreases. This is also successful to protect the brush 20 from yield over a long period of time. Further, the great number of filaments contacting the charge roller 2 can efficiently, uniformly clean the charge roller 2 for thereby insuring high image quality.

The weight of the brush 12, which is also open to choice, should preferably be 50 g or above, but 200 g or below, in order to guarantee the adequate bite of the brush 20 and smooth rotation of the brush roller 12. A weight below 50 g makes the amount of bite of the brush 20 short and thereby lowers the cleaning efficiency. A weight above 200 g makes the amount of bite excessive and thereby accelerates the yield of the brush.

The brush 20 may be affixed to the core 19 by any suitable method. When the base end of the brush 20 is affixed to the core 19 by electrostatic implantation, short filaments can be densely implanted in the core 19 and are free from yield over a long period of time. For example, adhesive may be coated on the core 19 over the axial range W, in which case a number of filaments will be electrostatically adhered to the adhesive to be affixed to the core 19 via the adhesive.

The filaments of the brush 20 may be formed of any suitable material. Experiments showed that nylon 66, PET (polyethylene terephthalate) or similar resin effectively reduced the yield of the brush 20 and insured the adequate amount of bite. If desired, the filaments may be formed of a material capable of electrostatically collecting toner from the charge roller 2 so as to further promote efficient cleaning.

Assume that the member to be cleaned is a cylindrical rotary body like the charge roller 2, FIG. 1. Then, as shown in FIG. 1, only if the brush roller 12 contacts a cylindrical body 2A anywhere in a range S above a horizontal plane H containing the axis O of the body 2A, the brush 20 can desirably contact the body 2A due to its own weight.

While the illustrative embodiment has concentrated on the charge roller 2, the cleaning device shown and described is similarly applicable to any one of the other members including the image carrier 1, belt 8, and intermediate image transfer body.

At least the cleaning device 18 and charge roller 2 or similar member to be cleaned may be constructed into the unit 14, as shown in FIG. 1. In this case, the brush 12 with filaments as short as 2 mm or less can be reduced in diameter and can therefore reduce the size of the unit 14. This is also true with an image forming apparatus including a cleaning device and a member to be cleaned.

In summary, it will be seen that the present invention provides a cleaning device including a long-life brush roller, a unit including the cleaning device, and an image forming apparatus including the cleaning device.

Various modifications will become possible for those skilled in the art after receiving the teachings of the present disclosure without departing from the scope thereof.

What is claimed is:

1. In a cleaning device comprising a brush roller having a brush that contacts a surface of a member to be cleaned, said brush contacts said surface due to a weight of said brush roller, whereby a desire amount of bit of said brush is achieved due to only the weight of said brush roller, and said brush roller has no driving motor and thereby rotates only by following a movement of said surface.

2. The device as claimed in claim 1, wherein the member to be cleaned comprises a charge roller that faces an image carrier for charging said image carrier.

3. The device as claimed in claim 1, wherein said brush has filaments having a length of 2 mm or below.

4. The device as claimed in claim 3, wherein the filaments have a diameter of 2 denier or below and a density of 20,000 filaments/$cm^2$ or above.

5. The device as claimed in claim 4, wherein said brush roller has a weight of 50 g or above, but 200 g or below.

6. The device as claimed in claim 5, wherein the filaments have base portions thereof affixed to a core of said brush roller by electrostatic implantation.

7. The device as claimed in claim 6, wherein the member to be cleaned comprises a cylindrical rotary body, and said brush contacts a surface of said rotary body at a position above a horizontal plane containing an axis of said rotary body.

8. The device as claimed in claim 7, wherein the member to be cleaned comprises a charge roller that faces an image carrier for charging said image carrier.

9. The device as claimed in claim 1, wherein the filaments have a diameter of 2 denier or below and a density of 20,000 filaments/$cm^2$ or above.

10. The device as claimed in claim 9, wherein said brush roller has a weight of 50 g or above, but 200 g or below.

11. The device as claimed in claim 10, wherein the filaments have base portions thereof affixed to a core of said brush roller by electrostatic implantation.

12. The device as claimed in claim 11, wherein the member to be cleaned comprises a cylindrical rotary body, and said brush contacts a surface of said rotary body at a position above a horizontal plane containing an axis of said rotary body.

13. The device as claimed in claim 12, wherein the member to be cleaned comprises a charge roller that faces an image carrier for charging said image carrier.

14. The device as claimed in claim 1, wherein said brush roller has a weight of 50 g or above, but 200 g or below.

15. The device as claimed in claim 14, wherein the filaments have base portions thereof affixed to a core of said brush roller by electrostatic implantation.

16. The device as claimed in claim 15, wherein the member to be cleaned comprises a cylindrical rotary body, and said brush contacts a surface of said rotary body at a position above a horizontal plane containing an axis of said rotary body.

17. The device as claimed in claim 16, wherein the member to be cleaned comprises a charge roller that faces an image carrier for charging said image carrier.

18. The device as claimed in claim 1, wherein the filaments have base portions thereof affixed to a core of said brush roller by electrostatic implantation.

19. The device as claimed in claim 18, wherein the member to be cleaned comprises a cylindrical rotary body, and said brush contacts a surface of said rotary body at a position above a horizontal plane containing an axis of said rotary body.

20. The device as claimed in claim 19, wherein the member to be cleaned comprises a charge roller that faces an image carrier for charging said image carrier.

21. The device as claimed in claim 1, wherein the member to be cleaned comprises a cylindrical rotary body, and said brush contacts a surface of said rotary body at a position above a horizontal plane containing an axis of said rotary body.

22. The device as claimed in claim 21, wherein the member to be cleaned comprises a charge roller that faces an image carrier for charging said image carrier.

23. In a unit including a cleaning device and a member to be cleaned thereby, said cleaning device comprises a brush roller having a brush that contacts a surface of said member to be cleaned, and said brush contacts said surface due to a weight of said brush roller, whereby a desired amount of bite of said brush is achieved due to only the weight of said brush roller, and said brush roller has no driving motor and thereby rotates only by following a movement of said surface.

24. In an image forming apparatus including a cleaning device and a member to be cleaned, said cleaning device comprises a brush roller having a brush that contacts a surface of said member to be cleaned, and said brush contacts said surface due to a weight of said brush roller, whereby a desired amount of bite of said brush is achieved due to only the weight of said brush roller, and said brush roller has no driving motor and thereby rotates only by following a movement of said surface.

25. In a cleaning device comprising a brush roller having a brush that contacts a surface of a member to cleaned, said brush contact said surface due to a weight of said brush roller and rotates by following a movement of said surface, wherein said brush roller has a weight of 50 g or above, but 200 g or below.

26. The device as claimed in claim 25, wherein the filaments have base ends thereof affixed to a core of said brush roller by electrostatic implantation.

27. The device as claimed in claim 25, wherein said brush roller has a weight of 50 g or above, but 200 g or below.

28. The device as claimed in claim 27, wherein the filaments have a diameter of 2 denier or below and a density of 20,000 filaments/$cm^2$ or above.

29. The device as claimed in claim 25, wherein the filaments have base portions thereof affixed to a core of said brush roller by electrostatic implantation.

30. The device as claimed in claim 29, wherein the member to be cleaned comprises a cylindrical rotary body, and said brush contacts a surface of said rotary body at position above a horizontal plane containing an axis of said rotary body.

31. The device as claimed in claim 30, wherein the member to be cleaned comprises a charge roller that faces an image carrier for charging said image carrier.

32. The device as claimed in claim 25, wherein the filaments have a diameter of 2 denier or below and a density of 20,000 filaments/$cm^2$ or above.

33. In a unit including a cleaning device and a member to be cleaned thereby, said cleaning device comprises a brush roller having a brush that contacts a surface of said member to be cleaned, and said brush contacts said surface due to a weight of said brush roller and rotates by following a movement of said surface, wherein said brush roller has a weight of 50 g or above, but 200 g or below.

34. In an image forming apparatus including a cleaning device and a member to be cleaned, said cleaning device comprises a brush roller having a brush that contacts a surface of said member to be cleaned, and said brush contacts said surface due to a weight of said brush roller and rotates by following a movement of said surface, wherein said brush roller has a weight of 50 g or above, but 20 g or below.

35. In a brush roller, filaments have a length of 2 mm or below, a diameter of 2 denier or below and a density of 20,000 filaments/$cm^2$ or above, and wherein said brush roller has a weight of 50 g or above, but 200 g or below.

36. The brush roller as claimed in claim 35, wherein the filaments have base ends thereof affixed to a core of said brush roller by electrostatic implantation.

* * * * *